US008718508B2

(12) United States Patent
Takiguchi

(10) Patent No.: US 8,718,508 B2
(45) Date of Patent: May 6, 2014

(54) IMAGE FORMING APPARATUS

(75) Inventor: Toshiki Takiguchi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 13/601,201

(22) Filed: Aug. 31, 2012

(65) Prior Publication Data

US 2013/0058678 A1 Mar. 7, 2013

(30) Foreign Application Priority Data

Sep. 2, 2011 (JP) ..... 2011-191276

(51) Int. Cl.
*G03G 21/00* (2006.01)
*G03G 15/02* (2006.01)

(52) U.S. Cl.
USPC ..... 399/100; 399/170

(58) Field of Classification Search
USPC ..... 399/99, 100, 170
See application file for complete search history.

(56) References Cited

U.S. PATENT DOCUMENTS 5,392,099 A 2/1995 Kusumoto et al.

FOREIGN PATENT DOCUMENTS

| | | | |
|---|---|---|---|
| JP | 6-161222 | A | 6/1994 |
| JP | 2003-241541 | A | 8/2003 |
| JP | 2008-176099 | A | 7/2008 |
| JP | 2010-14995 | A | 1/2010 |

*Primary Examiner* — David Gray
*Assistant Examiner* — Erika J Villaluna
(74) *Attorney, Agent, or Firm* — Birch, Stewart, Kolasch & Birch, LLP

(57) ABSTRACT

An image forming apparatus is provided with an image bearing unit, an intermediate transfer unit, a primary transfer unit, a pre-transfer charger, and a control portion. The pre-transfer charger is located downstream of the primary transfer unit and upstream of the secondary transfer unit in a revolving direction, faces the outer peripheral surface of the intermediate transfer unit along a perpendicular direction perpendicular to the revolving direction, and charges the intermediate transfer unit when voltage is applied. The control portion, at time when determination is made as to the necessity of cleaning the pre-transfer charger, secondarily transfers a cleaning assessment toner image by switching between a state in which the voltage is applied to the pre-transfer charger and a state in which the voltage is not applied to the pre-transfer charger, the cleaning assessment toner image being in a uniform density.

6 Claims, 8 Drawing Sheets

IMAGE FORMING APPARATUS

CROSS REFERENCE

This Nonprovisional application claims priority under 35 U.S.C. §119(a) on Patent Application No. 2011-191276 filed in Japan on Sep. 2, 2011, the entire contents of which are hereby incorporated by reference.

BACKGROUND OF THE INVENTION

The present invention relates to an electrophotographic image forming apparatus provided with a pre-transfer charger.

Some electrophotographic image forming apparatuses are provided with an image bearing element, a primary transfer element, an intermediate transfer element, and a secondary is transfer element. On the surface of the image bearing element, an electrostatic latent image is formed by using image data, and the electrostatic latent image is developed into a toner image. The primary transfer element primarily transfers the toner image formed on the image bearing element to the intermediate transfer element. The secondary transfer element secondarily transfers the toner image from the intermediate transfer element onto a sheet of paper.

A device as disclosed in Japanese Patent Laid-Open Publication No. 2010-14995 as the conventional image reading device is provided with a pre-transfer charger. The pre-transfer charger applies applied voltage with a polarity opposite to a polarity of a charged toner image to the intermediate transfer element. The charged state of the toner image that has been primarily transferred to the intermediate transfer element is stabilized to improve secondary transfer efficiency, thus preventing the toner from remaining on the secondary transfer element, which can become a cause for dirt on the reverse side of a sheet of paper during subsequent image forming processes.

However, the image forming apparatus disclosed in Japanese Patent Laid-Open Publication No. 2010-14995 cannot stabilize the charged state of the toner image formed on the intermediate transfer element corresponding to a portion to which the residual toner adheres when the residual toner adheres to the pre-transfer charger. In the portion in which the charged state of the toner image is not stable, a white streak is formed in the sheet of paper that has been subjected to an image forming process because the toner image is not transferred to the portion. The white streak is not easily visible, so that a user will often miss that the pre-transfer charger is dirty.

In view of the foregoing, an object of the present invention is to provide an image forming apparatus capable of detecting the presence of dirt of a pre-transfer charger, as well as a cleaning method of the pre-transfer charger.

SUMMARY OF THE INVENTION

An image forming apparatus according to the present invention is provided with an image bearing element, an intermediate transfer element, a primary transfer element, a pre-transfer charger, and a control portion. The pre-transfer charger is located downstream of the primary transfer element and upstream of the secondary transfer element in a revolving direction, faces the outer peripheral surface of the intermediate transfer element along a perpendicular direction perpendicular to the revolving direction, and charges the intermediate transfer element when voltage is applied. The control portion, at time when determination is made as to the necessity of cleaning the pre-transfer charger, secondarily transfers a cleaning assessment toner image by switching between a state in which the voltage is applied to the pre-transfer charger and a state in which the voltage is not applied to the pre-transfer charger, the cleaning assessment toner image being in a uniform density.

The foregoing and other features and attendant advantages of the present invention will become more apparent from the reading of the following detailed description of the invention in conjunction with the accompanying drawings.

BRIEF DESCRIPTION CF THE DRAWINGS

FIG. 7 is a view showing how a cleaning pad of the pre-transfer charger moves.

DETAILED DESCRIPTION OF THE INVENTION

Figure 1:
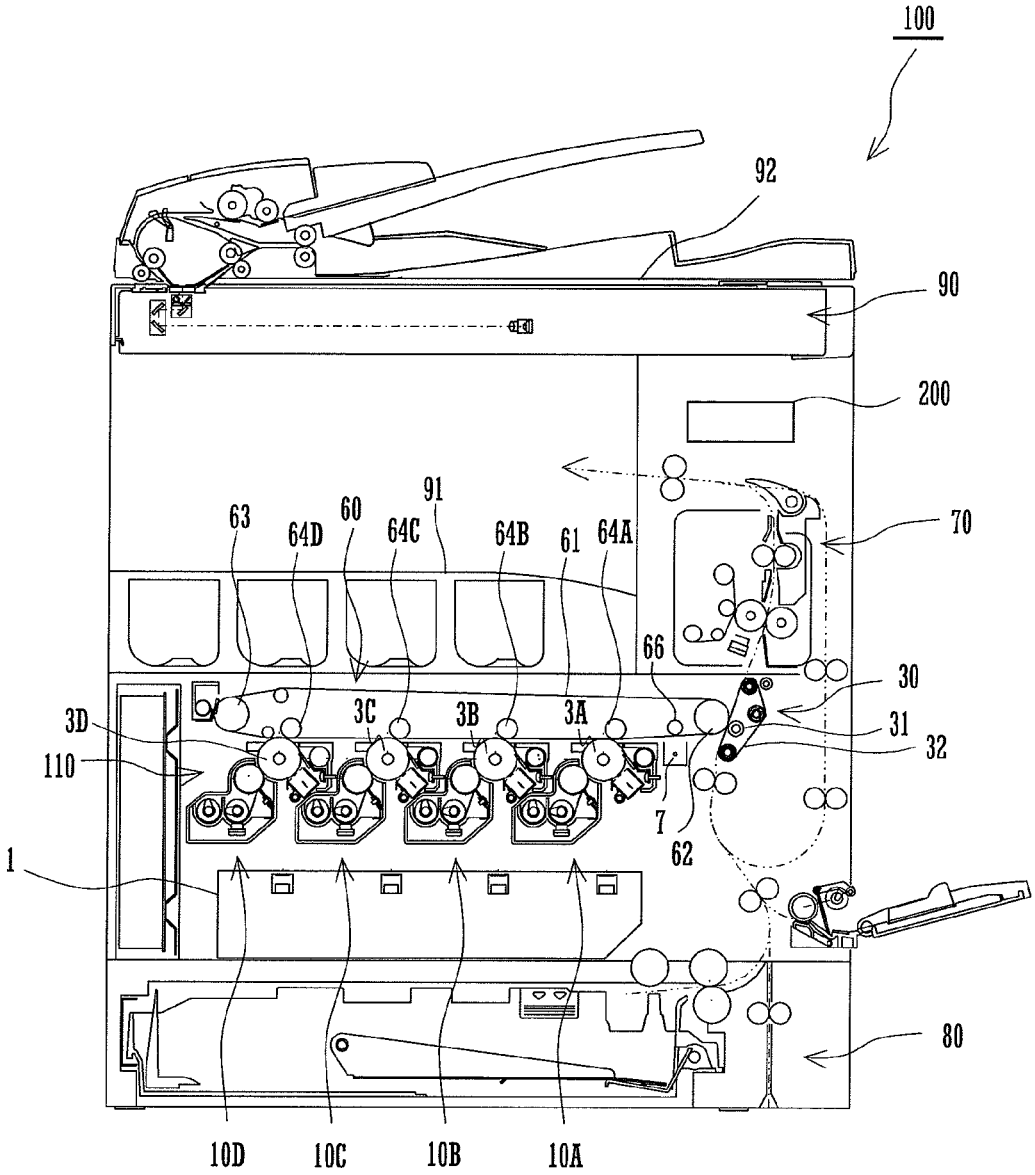
FIG. 1 is a schematic front elevational view of an image forming apparatus according to an embodiment of the present invention.

As shown in FIG. 1, an image forming apparatus 100 is provided with a sheet feeding portion 80, an image reading portion 90, an image forming portion 110, and a control portion 200. The image forming apparatus 100 is configured to perform a multi-color image forming process or a monochrome image forming process in the image forming portion 110 on a sheet of paper that has been fed from the sheet feeding portion 80 by using image data that the image reading portion 90 read from a document placed on a document platen 92. It is to be noted that the image forming apparatus 100 may perform an image forming process based on image data input from an external device.

The image forming portion 113 is provided with image forming units 10A to 10D, an intermediate transfer unit 60, a secondary transfer unit (which is equivalent to the secondary transfer element defined by the present invention) 30, and a fixing unit 70.

The image forming units 10A to 10D form a black toner image, a cyan toner image, a magenta toner image, and a yellow image on the surfaces of the photoreceptor drums (which are equivalent to the image bearing element defined by the present invention) 3A to 3D, respectively, according to the electrophotographic image forming process.

The intermediate transfer unit 60 has an intermediate transfer belt (which is equivalent to the intermediate transfer element defined by the present invention) 61, a driving roller 62, a driven roller 63, primary transfer rollers (which are equivalent to the primary transfer element defined by the present invention) 64A to 64D, a pre-transfer charger 7, and a counter roller 66.

The intermediate transfer belt 61 is stretched over the driving roller 62, the driven roller 63, and the counter roller 66, and moves along a circulation route that passes the image forming units 10D, 10C, 10B, and 10A in this order. Each of the primary transfer rollers 64A to 64D are disposed to face the photoreceptor drums 3A to 3D, with the intermediate transfer belt 61 held between the rollers and the drums, and the toner images formed on the peripheral surfaces of the respective photoreceptor drums 3A to 3D are primarily transferred onto the surface of the intermediate transfer belt 61.

In the color image forming process, a yellow toner image, a magenta toner image, a cyan toner image, and a black toner image are sequentially transferred onto the surface of the intermediate transfer belt 61 in an overlaying manner while the intermediate transfer belt 61 moves along the circulation route. In the monochrome image forming process, only a black toner image is transferred onto the surface of the intermediate transfer belt 61 while the intermediate transfer belt 61 moves along the circulation route.

The pre-transfer charger 7 is a corona discharge device, and is disposed downstream of the photoreceptor drum 3A and upstream of the secondary transfer unit 30 in the moving direction of the intermediate transfer belt 61. The pre-transfer charger 7 is configured to apply, to the toner image on the intermediate transfer belt 61, electric charges with the same polarity as the polarity of the charged toner prior to the secondary transfer. The counter roller 66 is disposed downstream of the primary transfer roller 64D and upstream of the driving roller 62 in the moving direction of the intermediate transfer belt 61. The pre-transfer charger 7 and the counter roller 66 are disposed to face each other, with the intermediate transfer belt 61 held between the pre-transfer charger and the counter roller.

The secondary transfer unit 30 is provided with a secondary transfer roller 31 and a secondary transfer belt 32. The secondary transfer belt 32 is stretched over a plurality of rollers including the secondary transfer roller 31, and moves along a predetermined circulation route. The secondary transfer roller 31 is disposed to face the driving roller 62, with the secondary transfer belt 32 and the intermediate transfer belt 61 held between the secondary transfer roller and the driving roller. The secondary transfer unit 30 secondarily transfers the toner image of the surface of the intermediate transfer belt 61 to the sheet of paper that has been fed between the intermediate transfer belt 61 and the secondary transfer belt 32.

The fixing unit 70 heats and pressurizes the sheet of paper onto which the toner image has been transferred, and firmly fixes the toner image transferred onto the sheet of paper on the surface of the sheet. The sheet of paper which has passed the fixing unit 70 is output to a paper output tray 91.

Figure 2:
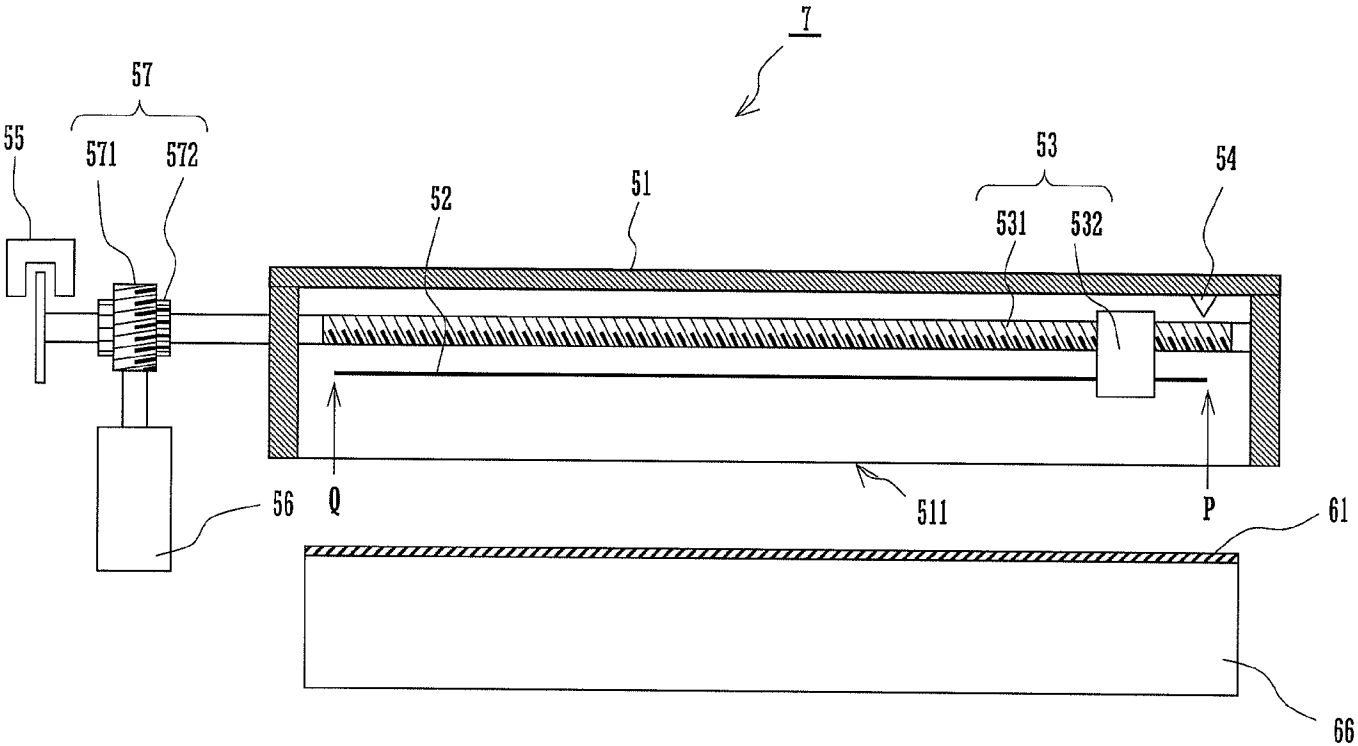
FIG. 2 is a sectional view of a pre-transfer charger included in the image forming apparatus.

As shown in FIG. 2, the pre-transfer charger 7 is provided with a housing 51, a corona wire 52, a cleaning element 53, a sensor 54, an encoder 55, a motor 56, and a worm gear 57.

The housing 51 has a rectangular parallelepiped shape with an opening 511 formed on the housing. The housing 51 is disposed so that the opening 511 faces the surface of the intermediate transfer belt 61 in a state in which the longitudinal direction of the housing corresponds to the axial direction of the counter roller 66.

The corona wire 52 is a discharge wire such as a tungsten wire with gold plating and is stretched over the inside of the housing 51 along the longitudinal direction. The corona wire 52 is connected to a direct current power source, and is applied with a voltage of 3.5 to 8 kV. Preferably, the voltage to be applied to corona wire 52 is 4.0 to 5.5 kV, with the current value at that time being 300 to 1000 μA. The discharge region of the corona wire 52 corresponds to the transfer range of the toner image on the intermediate transfer belt 61 in the axial direction of the counter roller 66.

The cleaning element 53 consists of a feed screw 531 and a cleaning pad 532. The feed screw 531 has a rod-like structure provided with a threaded portion, and is rotatably supported in the housing 51, being in parallel with the corona wire 52. The threaded portion of the feed screw 531 is screwed into a non-illustrated screw hole of the cleaning pad 532.

The cleaning pad 532 is pressed against the outer peripheral surface of the corona wire 52, and is disposed in the housing 51 with the rotation of the cleaning pad regulated. The cleaning pad 532 moves, by rotation of the feed screw 531, between the home position P located at an end on the front side and a return position Q located at an end on the rear side of the image forming apparatus 100. The cleaning pad 532 is located at each of the both ends of the corona wire 52 corresponding to the home position P and the return position Q. The sensor 54 detects the cleaning pad 532 in the home position P.

The encoder 55 is an encoder that measures movement in a rotary parallel direction of the feed screw 531, and measures a moving distance of the cleaning pad 532 from the home position P. The motor 56 selectively supplies rotations in a forward direction and in a backward direction to the worm gear 57.

The worm gear 57 consists of a worm 571 and a worm wheel 572. The worm 571 is fixed on the rotating shaft of the motor 56. The worm wheel 572 is fixed to the feed screw 531. The worm gear 57 decelerates the rotation of the motor 56, and transmits the rotation to the feed screw 531.

The cleaning pad 532 moves in the direction from the home position P to the return position Q when the motor 56 rotates forward, and moves in the direction from the return position Q to the home position P when the motor 56 rotates backward.

Figure 3:
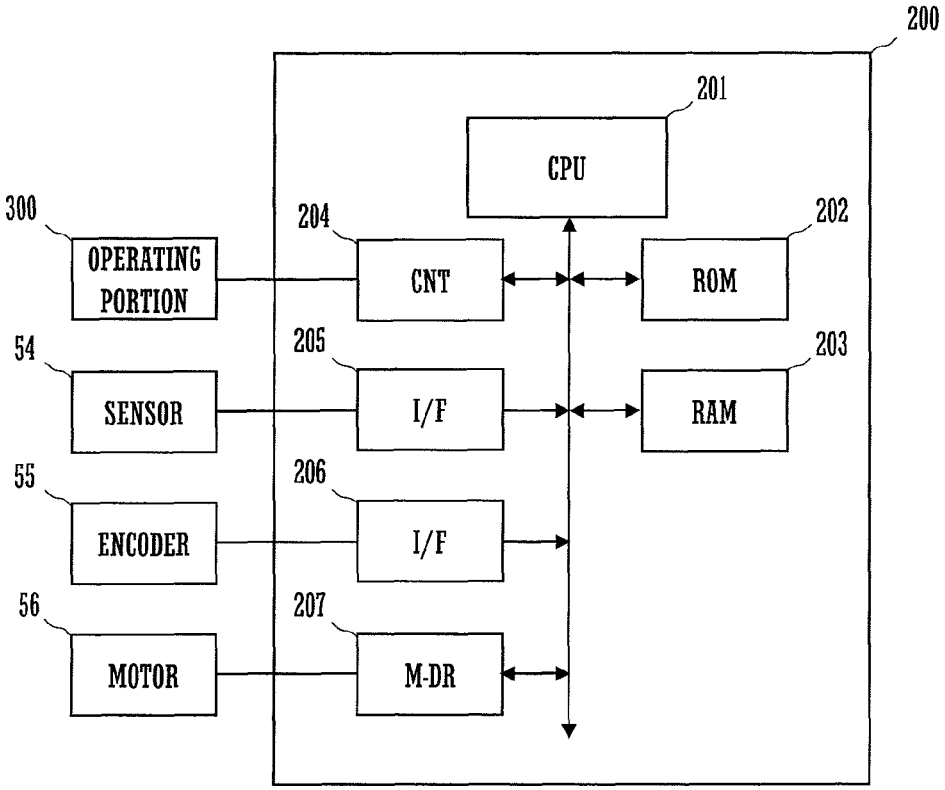
FIG. 3 is a block diagram of a control portion of the image forming apparatus.

As shown in FIG. 3, the control portion 200 includes a CPU 201 provided with a ROM 202 and a RAM 203 and is configured to connect the CPU 201 to a controller 204, interfaces 205 and 206, and a motor driver 207. The controller 204 is connected to an operating portion 300 disposed on the upper surface of the image forming apparatus 100. The interfaces 205 and 206 are connected to the sensor 54 and the encoder 55, respectively. The motor 56 is connected to the motor driver 207.

The CPU 201 executes programs that are written in the ROM 202 in advance to comprehensively control each portion of the image forming apparatus 100. The data output and input during the execution of the programs is stored in the RAM 203. In the ROM 202, cleaning assessment data as well as the programs which regulate the control operation of the CPU 201 is stored.

Figure 5A:
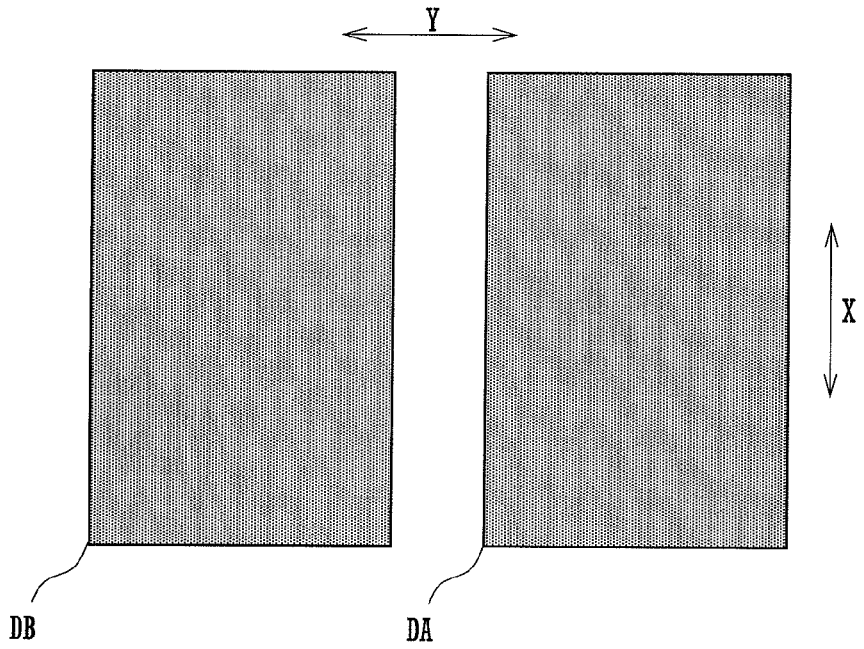
FIG. 5A shows an example of image data used at the time of the determination process.

The cleaning assessment data is image data used for determination of the necessity of the cleaning process of the pre-transfer charger 7. The cleaning assessment data, as shown in FIG. 5A as an example, is image data used to form toner images with uniform density within rectangular ranges DA and DB, each having a predetermined distance between the ranges in the circumferential direction Y, with width equaling the entirety of the image forming area in the axial direction X of the photoreceptor drum 3A, and with a predetermined length in the circumferential direction Y.

The controller 204 inputs operation data of a key switch in the operating portion 300 into the CPU 201 while supplying, to the operating portion 300, display data for display which the CPU 201 has prepared. The motor driver 207 drives the motor 56 based on the driving data output from the CPU 201.

A detection signal of the cleaning pad 532 detected by the sensor 54 and a detection signal of the rotation of the feed screw 531 detected by the encoder 55 are input into the CPU 201 through each of the interfaces 205 and 206.

Figure 4:
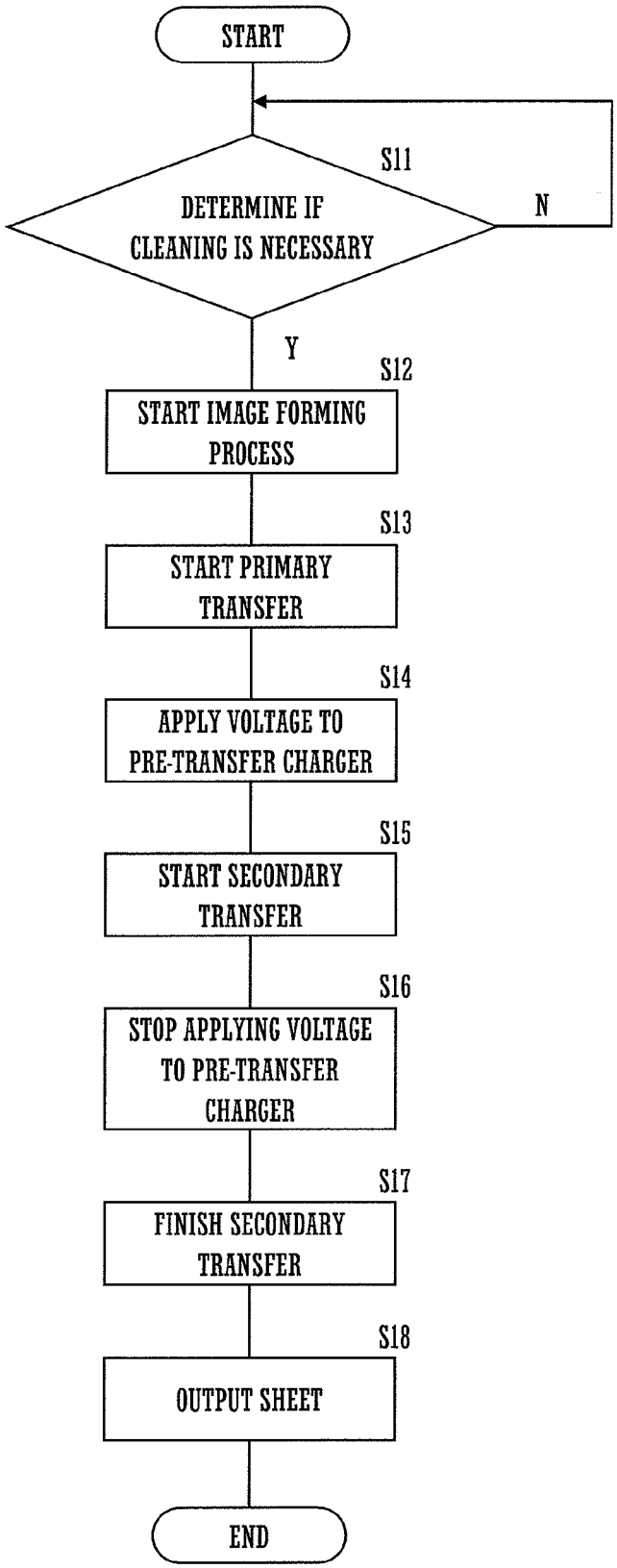
FIG. 4 is a flow chart showing process steps at time of a determination process in the image forming apparatus.

The following describes a determination process to determine as to the necessity of cleaning the pre-transfer charger 7 with reference to the flow chart as shown in FIG. 4.

As shown in FIG. 4, when the CPU 201 reaches a time to determine the necessity of cleaning of the pre-transfer charger 7, such as when the cumulative total count of image forming processes reaches a predetermined number (S11), the CPU 201 will start performing the image forming process based on the cleaning assessment data (S12). As an example, the toner image based on the cleaning assessment data is formed on the photoreceptor drum 3A.

The CPU 201 starts the primary transfer of the toner image from the photoreceptor drum 3A to the intermediate transfer belt 61 (S13), and then, before starting the secondary transfer to the toner image from the intermediate transfer belt 61 to the sheet of paper, applies voltage to the pre-transfer charger 7 (S14). The CPU 201 further starts the secondary transfer (S15), and then before the secondary transfer ends, stops applying the voltage to the pre-transfer charger 7 (S16). The CPU 201, when the secondary transfer ends (S17), outputs the sheet on which the image based on the cleaning assessment data is formed (S18).

Figure 5B:
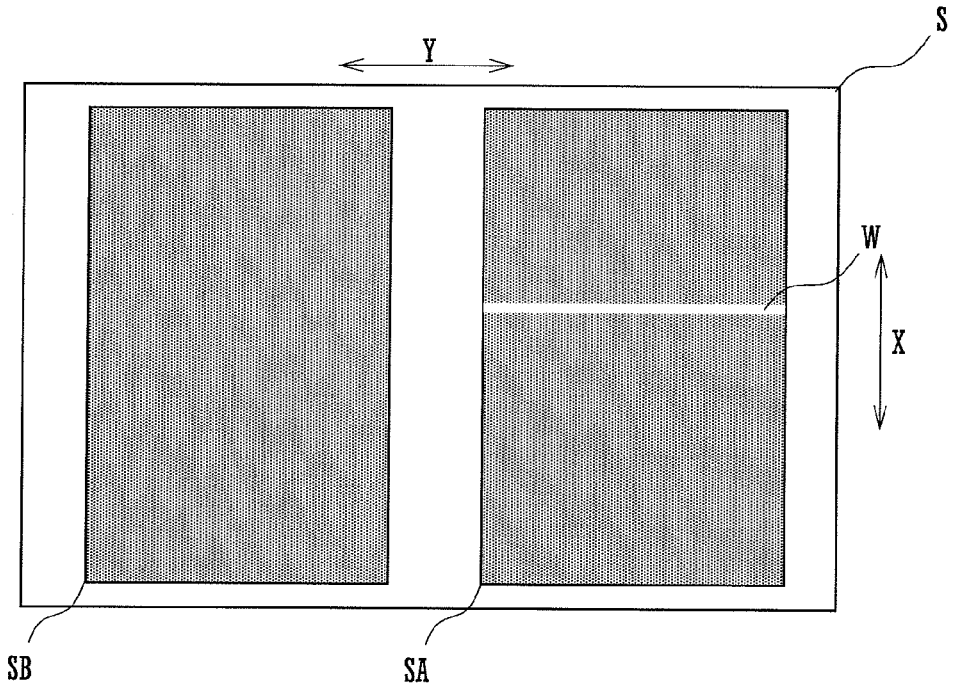
FIG. 5B shows an example of a sheet of paper to be output at the time of the determination process.

As shown in FIG. 5B, the first image SA and the second image SB are formed on the sheet S output at the time of the discrimination process. The first image SA is an image that is secondarily transferred from the intermediate transfer belt 61 while the voltage is applied to the pre-transfer charger 7. The second image SB is an image that is secondarily transferred from the intermediate transfer belt 61 while the application of the voltage to the pre-transfer charger 7 is stopped.

In a case where dirt adheres to a portion of the corona wire 52 of the pre-transfer charger 7, a white streak W is is formed in the first image SA along the direction Y. A user can easily visually recognize the white streak W formed in the first image SA by contrast with the second image SB, and can easily determine the necessity of cleaning the pre-transfer charger 7.

Figure 6:
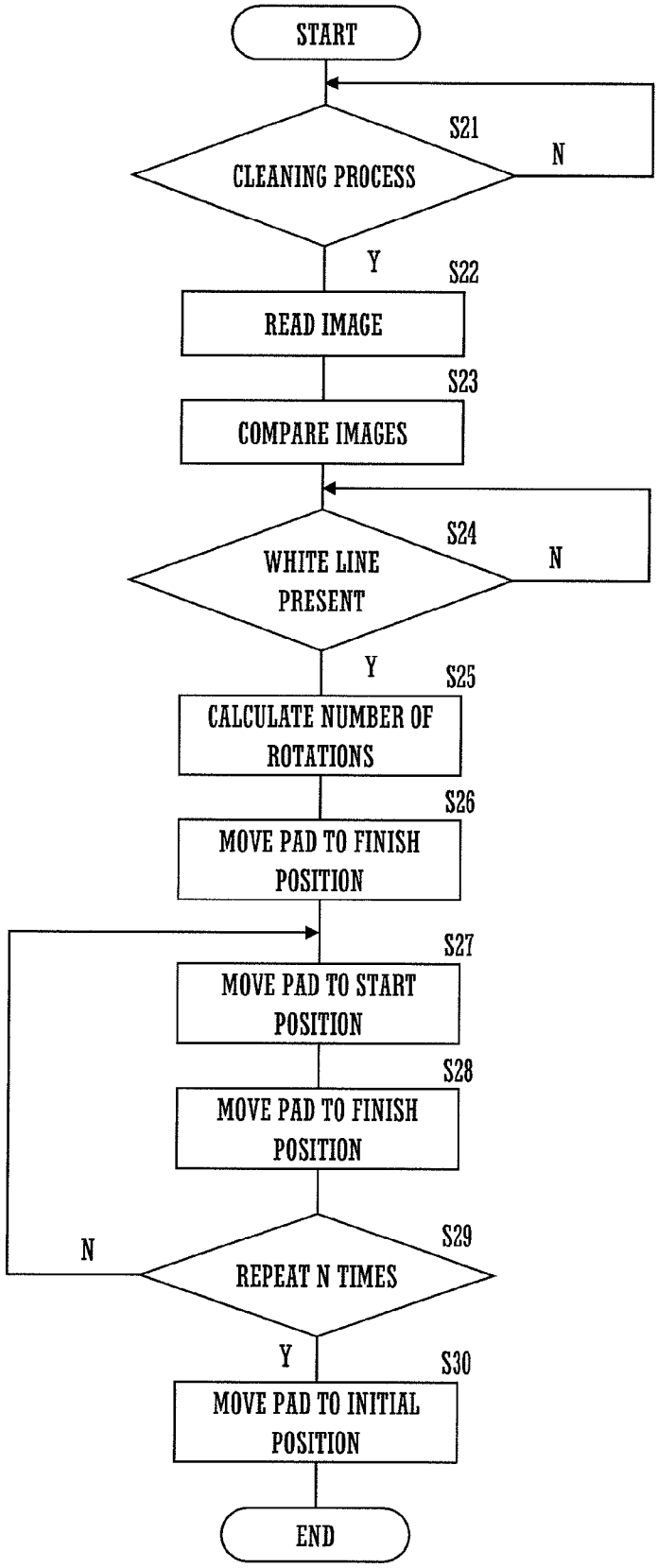
FIG. 6 is a flow chart showing process steps at time of a cleaning process in the image forming apparatus.

Subsequently, the cleaning process of the pre-transfer charger 7 will be described with reference to the flow chart as shown in FIG. 6. In advance of the start of a cleaning process, the user places a sheet S of paper which is output at the time of the determination process on the document platen 92.

As shown in FIG. 6, when the CPU 201 receives an instruction of the cleaning process by the operation of the operating portion 300 (S21), and reads the first image SA and the second image SB from the sheet S of paper by the image reading portion 90 (S22). Then, the CPU 201 determines the presence of a white streak in the first image SA by comparison with the second image (S23), and ends the process when no white streak is generated.

The CPU 201 specifies a cleaning start position CS and a cleaning end position CE on the corona wire 52 corresponding to the position of the white streak in the first image SA when the m white streak is generated on the first image SA (S24). As shown in FIG. 7, on the corona wire 52, the home position P, the cleaning start position CS, the cleaning end position CE, and the return position Q are positioned in this order.

Here, the CPU 201 calculates the first number of rotations and the second number of rotations which are the number of rotations of the feed screw 531, necessary to move the cleaning pad 532 from the home position P to the cleaning start position CS and from the home position P to the cleaning end position CE (S25).

Figure 7A:
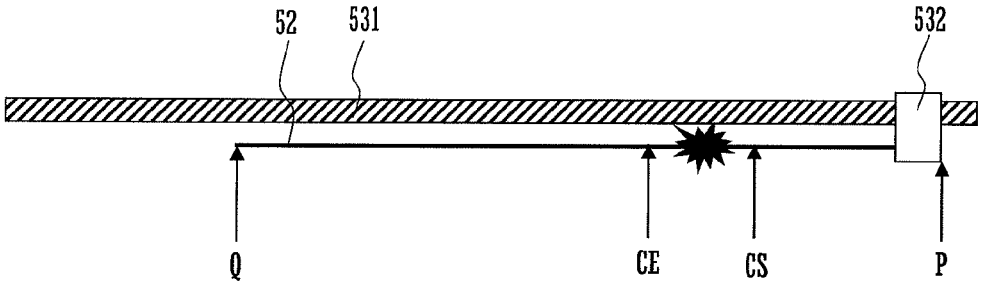
FIG. 7A shows a case where the cleaning pad is in a home position.
Figure 7B:
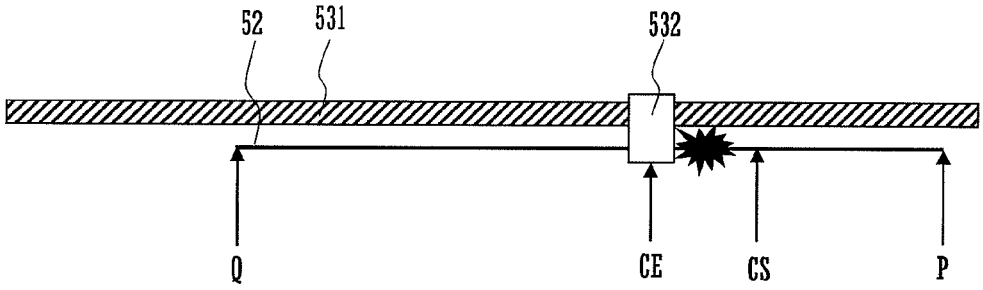
FIG. 7B shows a case where the cleaning pad is in an end position.

To begin with, the CPU 201 rotates the motor 56 forward until such time that the encoder 55 detects the number of rotations to be equal to the second number of rotations, and moves the cleaning pad 532 positioned in the home position P as shown in FIG. 7A to the cleaning end position CE as shown in FIG. 7B (S26).

Figure 7C:
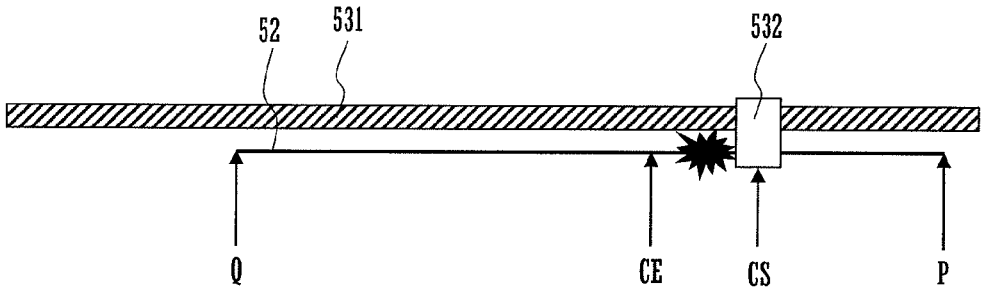
FIG. 7C shows a case where the cleaning pad is in a start position.

Next, the CPU 201 rotates the motor 56 backward until such time that the encoder 55 detects the number of rotations to be equal to the differential number of rotations obtained by subtracting the second number of rotations from the first number of rotations, and then moves the cleaning pad 532 to the cleaning start position CS as shown in FIG. 7C (S27).

Further, the CPU 201 rotates the motor 56 forward until such time that the encoder 55 detects the number of rotations to be equal to the differential number of rotations, and again moves the cleaning pad 532 to the cleaning end position CE as shown in FIG. 7B (S28).

The CPU 201 repeats the processes S27 and S28 for a predetermined N times (S29), then moves the motor 56 backward until the sensor 54 detects the cleaning pad 532, and moves the cleaning pad 532 to the home position as shown in FIG. 7A (S30).

Through the above processes, the CPU 201 determines the presence of the dirt which adheres to the corona wire 52 from the sheet S of paper that is output at the time of the determination process, and cleans only the dirty portion in the corona wire 52. Therefore, the corona wire 52 can be cleaned efficiently, and also the wear to the cleaning pad 532 can be minimized.

It should be understood that while in the foregoing embodiments the first image SA and the second image SB were formed on one sheet S of paper, the images may be formed on separate sheets. In this case, images are sequentially read from a sheet on which the first image SA is formed, and a sheet on which the second image SB is formed.

Figure 8:
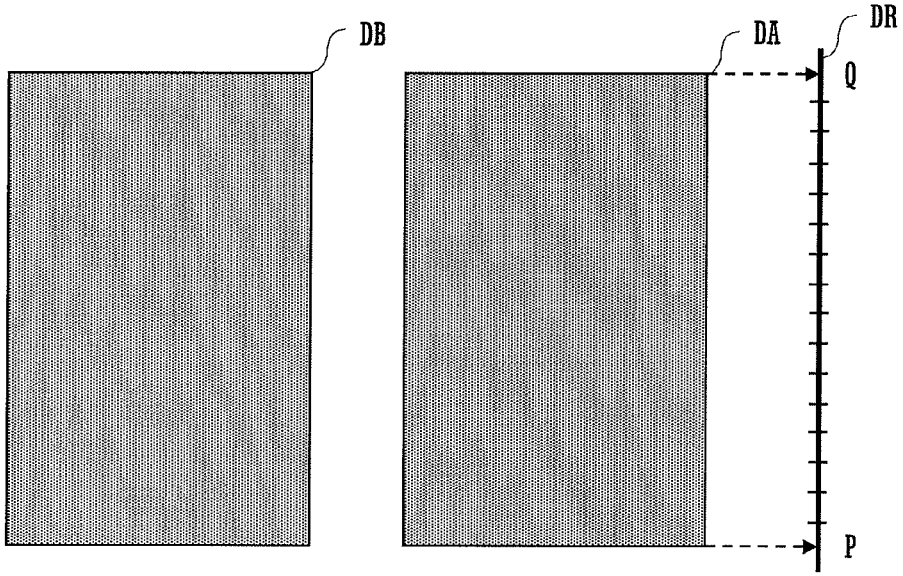
FIG. 8 exemplifies another image data used at the time of the determination process.

In addition, as cleaning assessment data, image data including scale data DR may be used as shown in FIG. 8. When a user inputs a dirty position of the corona wire 52 read from the scale data DR through the operating portion 300, reading of the sheet S can be omitted.

Furthermore, the cleaning assessment data need not necessarily be image data that forms toner images both of the two regions of rectangle ranges DA and DB. Even under a situation where image data is for forming a toner image with uniform density in a single rectangular range, the CPU 201 can perform the same process by detecting the presence of a white streak within the full length in the direction perpendicular to the longitudinal direction of the corona wire 52. In this case, secondary transfer need not be performed in a state where the application of the voltage to the pre-transfer charger is stopped.

The above described embodiments are to be considered in all respects as illustrative and not restrictive. The scope of the present invention is defined not by above described embodiments but by the claims. Further, the scope of the present invention is intended to include all modifications that come within the meaning and scope of the claims and any equivalents thereof.

What is claimed is:

1. An image forming apparatus comprising:

an image bearing element having a surface on which a toner image is formed;

an intermediate transfer element of which an outer peripheral surface moves along a predetermined revolving direction;

a primary transfer element that primarily transfers the toner image from the surface of the image bearing element to the outer peripheral surface of the intermediate transfer element;

a secondary transfer element that secondarily transfers the toner image from the intermediate transfer element to a sheet of paper;

a pre-transfer charger that is located downstream of the primary transfer element and upstream of the secondary transfer element in the revolving direction, faces the outer peripheral surface of the intermediate transfer element along a perpendicular direction perpendicular to the revolving direction, and charges the intermediate transfer element when voltage is applied; and a control portion that, at a time when a determination process is performed as to necessity of cleaning the pre-transfer charger, secondarily transfers a cleaning assessment toner image by switching between a state in which the voltage is applied to the pre-transfer charger and a state in which the voltage is not applied to the pre-transfer charger, the cleaning assessment toner image having a uniform density within a range of a predetermined length along the revolving direction and within an entirety of an image forming region in the perpendicular direction.

2. The image forming apparatus according to claim 1, further comprising a cleaning element that cleans the pre-transfer charger, wherein the control portion is configured to operate the cleaning element based on the cleaning assessment toner image, which has been secondarily transferred in the determination process, during a cleaning process in which the pre-transfer charger is cleaned.

3. The image forming apparatus according to claim 2, wherein:

the cleaning element is configured to freely move along the perpendicular direction in an entirety of the pre-transfer charger; and the control portion, during the cleaning process in which the pre-transfer charger is cleaned, is configured to reciprocate the cleaning element for a predetermined number of times along a range corresponding to a different part of the perpendicular direction, the different part being a difference between the cleaning assessment toner image before switching the state and the cleaning assessment toner image after switching the state, the state of being in which the voltage is applied in the cleaning assessment toner image which has been secondarily transferred to the sheet in the determination process.

4. The image forming apparatus according to claim 3, further comprising an image reading portion that reads an image from a document, wherein the control portion, during the cleaning process in which the pre-transfer charger is cleaned, is configured to extract the different part from the image read by the image reading portion.

5. The image forming apparatus according to claim 3, further comprising an operating portion that receives an input operation to input the different part.

6. The image forming apparatus according to claim 5, wherein the cleaning assessment toner image includes a toner image with a scale in the perpendicular direction.

* * * * *